United States Patent [19]

Tonnessen

[11] 4,297,960

[45] Nov. 3, 1981

[54] TANK WITH A DOME ONBOARD SHIPS

[75] Inventor: Arne Tonnessen, Jelφy, Norway

[73] Assignee: Moss Rosenberg Verft A.S., Jeloy, Norway

[21] Appl. No.: 46,428

[22] Filed: Jun. 7, 1979

Related U.S. Application Data

[63] Continuation-in-part of Ser. No. 831,917, Sep. 9, 1977, abandoned, which is a continuation of Ser. No. 687,935, May 19, 1976, abandoned.

[30] Foreign Application Priority Data

Jun. 5, 1975 [NO] Norway ..... 751986

[51] Int. Cl.[3] ..... B63B 25/08; B65D 88/04; B65D 88/12

[52] U.S. Cl. ..... 114/74 A; 220/1 B; 220/5 A; 220/71; 220/901

[58] Field of Search ..... 114/74 A, 74 R; 220/5 A, 1 B, 71, 901

[56] References Cited

U.S. PATENT DOCUMENTS

| | | | |
|---|---|---|---|
| 2,436,411 | 2/1948 | Weaver | 220/901 X |
| 2,731,334 | 1/1956 | Wissmiller et al. | 220/1 B X |
| 3,043,256 | 7/1962 | Corlett | 114/74 A |
| 3,067,713 | 12/1962 | Meesen | 114/74 A |
| 3,199,712 | 8/1965 | Nurkiewicz | 220/3 |
| 3,495,732 | 2/1970 | Clarke et al. | 114/74 A X |
| 3,797,437 | 3/1974 | Cowles | 114/74 A |
| 3,968,764 | 7/1976 | Kuamsdal | 114/74 A |
| 3,984,994 | 10/1976 | Ehle et al. | 220/901 X |

*Primary Examiner*—Allan N. Shoap

*Attorney, Agent, or Firm*—Harold L. Stults; Pasquale A. Razzano

[57] ABSTRACT

A conical transition between the vaulted upper part of a tank onboard a ship and the tank dome is disclosed. This conical transition or cone solves vibration problems in the tank by increasing the natural frequency of the tank dome.

3 Claims, 3 Drawing Figures

TANK WITH A DOME ONBOARD SHIPS

Figure 1:
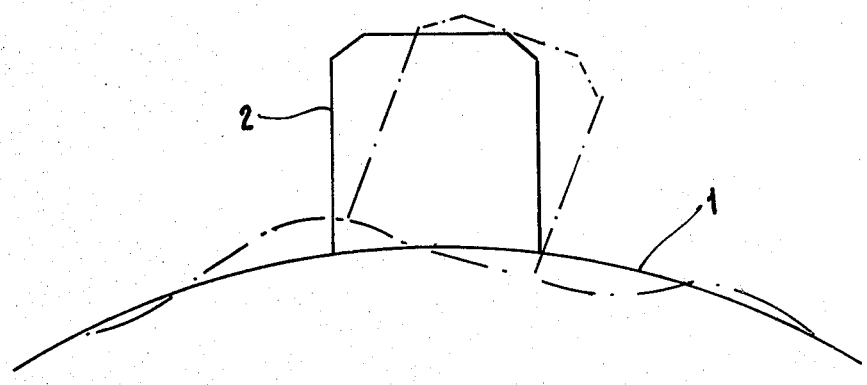
FIG.1 (PRIOR ART)

This application is a continuation-in-part of U.S. patent application Ser. No. 831,917, filed Sept. 9, 1977, now abandoned, which is a continuation of U.S. patent application Ser. No. 687,935, filed May 19, 1976, now abandoned.

On the top of tanks onboard marine vessels, such as ships or barges carrying special cargos, as for example LNG and LPG and other special liquid cargos, there is usually arranged a so-called dome. This dome serves to provide a gas phase volume above the liquid in the tank, and on the dome is often mounted fairly heavy operating equipment as, for example, motors, instruments, piping connections, valves and other devices used in filling or emptying the tank. The dome has a natural frequency dependent upon its shape and structure. Since the tank is placed onboard a ship, the dome will, because of excitations from the ship's propellers and other forces in the ship, have a tendency to vibrate. Vibrations may be vertical or transverse and can cause damage to the dome and/or the tank. The vibration problem has been dealt with in the past by reinforcing or stiffening the actual shell of the tank near its juncture with the dome so that the dome's natural oscillating frequency will be higher than the existing frequencies to which the tank and dome may be normally subjected.

As mentioned, it has been found that with spherical tanks or tanks having vaulted or spherical upper portions on which a dome is mounted, the dome is subjected to vibrations due to excitation from the ship's engine and propeller. Such domes are typically mounted on the tanks such that their periphery intersects the vaulted or spherical upper portion of the tank at a peripheral point of juncture and are secured to the tank at that point. However, with that arrangement the dome may vibrate laterally in resonance with the propeller frequency or other ship vibrations with the result that the dome-tank juncture may deteriorate. Damage may also be caused to piping or equipment mounted on the dome due to such vibration or due to the relative vibration between the dome and the adjacent hull structure. Thus, it is necessary in such structures to adjust or force the dome's natural frequency into a frequency range where outside excitations will not occur or effect it. Heretofore stiffening rings and/or radial cross braces have been used in the tank or dome to change the natural frequency of the dome and tank mounting, but these are expensive solutions and, in particular, the use of radial stiffeners may introduce undesirable local stresses.

Applicant has found that the natural frequency of the dome is sensitive to deviations in the shape of the supporting tank shell at the juncture of the shell and the dome and, it has been found further that the desired increase in the natural frequency of the dome can be achieved by the use of a simple frustro-conical mounting ring or transition section to connect the dome to the tank. This transition section or ring is positioned to be tangent to the spherical tank at its outer edges and is secured to the dome at a point of juncture above the point at which the dome would otherwise intersect and join the spherically curved or vaulted tank top in the prior art arrangements. Thus the exterior angle between the dome and the transition section of the tank at their juncture is greater in the present invention than the angle between the dome and tank at their juncture in prior arrangements. The straight conical side wall of the transition section or ring of the tank results in increased stiffness against flexing of the type shown in FIG. 1 of this application. As a result, the natural frequency of the dome is increased.

As mentioned, several ways to achieve increased stiffness in the mounting of the dome have been previously proposed. For spherical tanks, it has, for example, been proposed to arrange a stiffening ring on the shell of the tank. Combined with radial cross braces, and possibly an increased plate thickness, the stiffness may be increased. A common factor in a solution of this type is that it entails higher material and labor costs. Stiffenings on the shell of the tank itself are moreover undesirable because of the danger of stress concentration and notching.

The present invention has been particularly developed for spherical tanks whereas will be appreciated the vaulted spherical upper part of the tank shell is symmetrical about a vertical axis through the dome, but can naturally also be used for other such symmetrical tank configurations where there are similar vibration problems. The main idea behind the present invention is that the necessary dome structural stiffness is achieved by making the top of the tank at the connection or point of juncture between the tank and the dome conical. Such a construction will cause a considerable increase in the natural oscillating frequency of the dome even for a small extent of conical area.

According to the invention there is therefore provided a tank with a dome onboard a ship or other marine vessel where the upper part of the tank is vaulted, characterized in that the tank shell at the connection to a point of juncture with the dome is formed as a frustro-conical ring. The transition at this juncture between dome and tank may preferably be such that the generatrix of the cone is tangent to the tank shell at the juncture between the base of the frustro-conical ring and the tank, i.e., tangent to the meridian of the sphere when it is a question of a spherical tank.

The invention will be explained more in detail with reference to the drawings. In the drawings, FIG. 1 shows the upper part of a spherical tank, placed onboard a ship, with a dome attached, of a per se known embodiment, and FIG. 2 shows a similar section of a spherical tank placed onboard a ship, with an embodiment of the transition between the dome and the tank shell according to the invention.

Figure 2:
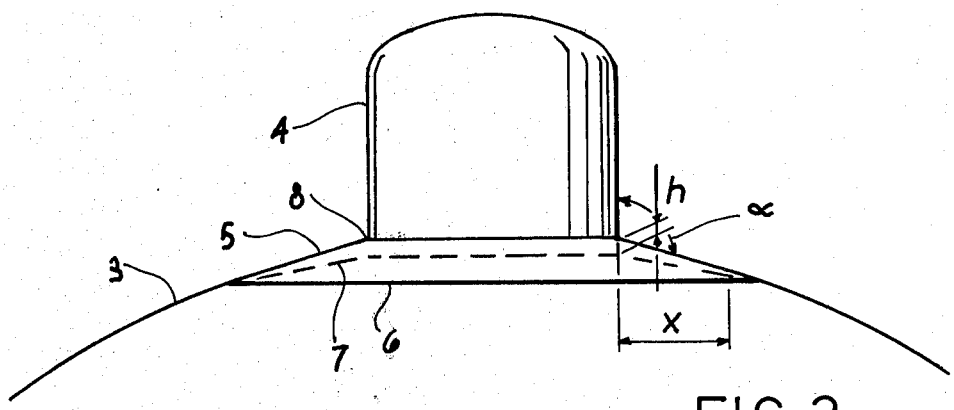
Figure 3:
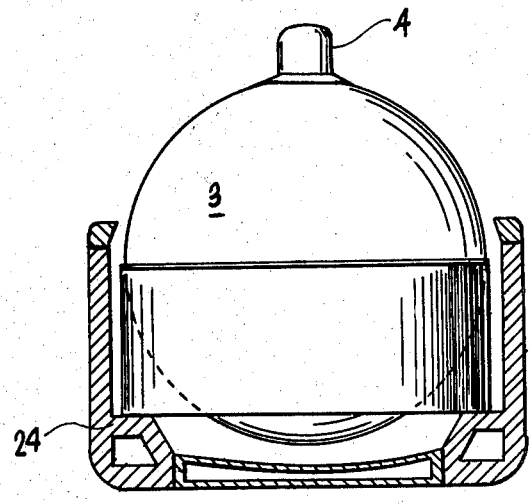

FIG. 3 is a schematic sectional view showing the tank of FIG. 2 supported in a conventional manner in a ship.

In FIG. 1, the vaulted tank shell of a spherical tank is indicated in solid lines by the reference numeral 1 and the dome is indicated by numeral 2. The dotted lines show how the dome tends to displace under the influence of vibration. The drawing is naturally exaggerated, in order to show the lateral vibrations and principle clearly. Vertical vibrations can also arise. As seen therein the spherical upper vaulted end of the tank joins at a peripheral point of junction 2' at an angle $\alpha$ of about 90°.

FIG. 2 shows a spherical vaulted tank shell 3 with the dome 4 attached in accordance with the present invention. In this case, in the transition area adjacent the juncture between the dome and the tank shell, the tank is formed with a frustro-conical transition section or ring 5. At the junction between the ring 5 and the spherical shell 3 the generatrix or surface of the ring 5 is tangent to the meridian or surface of the sphere 3, however, this is not a requirement. Spherical tank 3 is shown supported in a schematic of a sea going vessel 24 in a conventional manner.

As also seen in FIG. 2, with the frustro-conical ring 5 tangentially secured at its lower or larger base 6 to the vaulted upper portion of tank 3, the ring will join dome 2 at a higher point along its side than occurs in the conventional arrangement of FIG. 1. For illustrative purposes the arrangement of FIG. 1, wherein the spherical upper end of the tank joins the dome, is shown in dotted lines 7, show that the point of juncture 8 of the smaller or upper base of the ring with the dome projects above the extension or continuation of the vaulted upper end of the tank. Of course it is understood that in the actual construction of the embodiment of FIG. 2 the vaulted section of the tank shown by dotted lines 7 is not actually present and the transition section or ring 5 is actually part of the tank. That is, at the juncture with the dome the tank is conical, not spherical.

As seen in FIG. 2, the dome height above the ring 5 is substantially greater than the height of the ring.

In FIG. 2, x designates the radial extent of the frustro-conical transition ring or section measured from its point of juncture with the dome and h designates the height of the ring above the spherical meridian at the periphery of the dome, i.e., above the point at which dome 4 would have intersected the extended spherical vaulted upper end of tank 3 (shown in dotted lines 7 in FIG. 2) in a conventional arrangement such as shown in FIG. 1. This makes the angle $\alpha$ between the dome and ring greater than the corresponding exterior angle between the dome and tank juncture of FIG. 1 and this increases the natural frequency of the dome.

The table shows alternatives for extension of the conical ring for a tank with a diameter of 24 meters and a conical radius of 1.8 meters, and what influence this has on the natural oscillating frequency of the dome. The increase in oscillating frequency is given in relation to the dome natural frequency for a dome attached directly to the spherical tank. It is evident from the table that a conical tank top gives a considerable increase in the natural oscillating frequency even for a very small extent of the conical area, i.e., conical rings having relatively small bases or widths, and heights relative to the dome.

Change in the normal frequency for domes with conical tank tops.

| x (mm) | h (MM) | % increase in normal frequency |
|---|---|---|
| 500 | 12 | 4.3% |
| 1000 | 45 | 18.1% |
| 1500 | 100 | 35.4% |

What is claimed is:

1. A closed tank means for transporting liquefied gases on board a marine vessel comprising a spherical tank shell, a frusto-conical transition wall and a dome which has an annular bottom edge portion, said tank shell and said transition wall and said dome all having a common vertical axis, said tank shell being truncated by a horizontal plane across the upper part of the top hemisphere of said tank shell, the portion of the sphere of said tank shell above said horizontal plane comprising a hypothetical extension of said tank shell from said horizontal plane to a height where its diameter is equal to the diameter of said annular bottom edge portion of said dome, said dome being for containing operating equipment for the tank, said frusto-conical transition wall being for securing said dome to said tank shell at said horizontal plane and defining means for increasing the natural frequency of said dome and thereby reducing vibration of said dome, said frusto-conical transition wall being substantially tangential to the upper portion of said tank shell at said horizontal plane, said annular bottom edge portion of said dome being coextensive with the upper edge portion of said frusto-conical transition wall and being attached thereto throughout their respective diameters at a height above that of the top of said hypothetical extension of said sphere, the longitudinal, axial length of said frusto-conical transition wall being substantially less than the longitudinal, axial length of said dome, whereby said frusto-conical transition wall stiffens said dome relative to said tank wall and thereby increases the natural frequency of vibration of said dome to a level above the frequencies of vibration to which said dome would otherwise be subjected while the vessel is at sea.

2. A tank means for transporting liquefied gases onboard a marine vessel as defined in claim 1 wherein the distance (h) between the juncture of said transition wall and the dome and the hypothetical intersection of the extension of the periphery of the dome and said hypothetical extension of said outer surface of said tank shell is between 12 and 100 mm.

3. A tank for transporting liquefied gases onboard a marine vessel as defined in claim 2 wherein said frusto-conical ring has a radius of 1.8 meters at its lower larger base.

* * * * *